US007461420B2

(12) United States Patent
Kim

(10) Patent No.: US 7,461,420 B2
(45) **Date of Patent: *Dec. 9, 2008**

(54) ARTICULATING BED

(76) Inventor: Willie Kim, 2124 W. Cherrywood La., Anaheim, CA (US) 92804

( * ) Notice: Subject to any disclaimer, the term of this patent is extended or adjusted under 35 U.S.C. 154(b) by 0 days.

This patent is subject to a terminal disclaimer.

(21) Appl. No.: 11/771,984

(22) Filed: Jun. 29, 2007

(65) Prior Publication Data

US 2007/0251009 A1 Nov. 1, 2007

Related U.S. Application Data

(63) Continuation of application No. 11/336,238, filed on Jan. 20, 2006, now Pat. No. 7,237,286.

(51) Int. Cl.
*A47B 7/00* (2006.01)
*A47B 7/02* (2006.01)

(52) U.S. Cl. ..... 5/613; 5/617; 5/618

(58) Field of Classification Search ..... 5/60–610, 5/613, 617, 618, 934
See application file for complete search history.

(56) References Cited

U.S. PATENT DOCUMENTS

| | | | | |
|---|---|---|---|---|
| 131,488 | A * | 9/1872 | Wilkes | 5/617 |
| 185,779 | A * | 12/1876 | Praul | 5/242 |
| 5,090,071 | A | 2/1992 | Bathrick et al. | |
| 5,205,004 | A | 4/1993 | Hayes et al. | |
| 5,468,216 | A | 11/1995 | Johnson et al. | |
| 5,515,561 | A | 5/1996 | Suggitt et al. | |
| 5,537,701 | A | 7/1996 | Elliott | |
| 5,568,661 | A | 10/1996 | Bathrick et al. | |
| 5,747,129 | A * | 5/1998 | Malofsky et al. | 428/36.4 |
| 6,360,386 | B1 | 3/2002 | Chuang | |
| 6,393,641 | B1 | 5/2002 | Hensley | |
| 6,789,280 | B1 | 9/2004 | Paul | |
| 6,826,793 | B2 | 12/2004 | Tekulve | |
| 2003/0121098 | A1 | 7/2003 | Wei | |
| 2005/0160530 | A1 | 7/2005 | Taguchi et al. | |
| 2005/0166323 | A1 | 8/2005 | Kawakami et al. | |

FOREIGN PATENT DOCUMENTS

| | | | |
|---|---|---|---|
| EP | 0581 474 | B1 | 4/1997 |
| GB | 2269916 | A | 2/1994 |
| WO | WO 03073973 | A1 | 2/2003 |
| WO | 2004/018901 | A1 | 3/2004 |

* cited by examiner

*Primary Examiner*—Patricia Engle
*Assistant Examiner*—Gilbert Lee
(74) *Attorney, Agent, or Firm*—Knobbe Martens Olson & Bear LLP

(57) ABSTRACT

Disclosed is an articulated bed has a stationary frame and a plurality of mattress support sections defining a mattress support area, the support sections including: a left section, a right section, a head section and a leg section. Each of the left, right, head and leg sections are hingedly movable, thereby enabling a patient to turn the body to the left or right and to sit up or lift the legs.

28 Claims, 6 Drawing Sheets

ARTICULATING BED

CROSS-REFERENCE TO RELATED APPICATIONS

This application is a continuation of U.S. patent application Ser. No. 11/336,238, filed Jan. 20, 2006, now U.S. Pat. No. 7,237,286 issued on Jul. 3, 2007. U.S. patent application Ser. No. 11/336,238 is hereby incorporated herein by reference in its entirety.

BACKGROUND

1. Field

This disclosure relates generally to articulating beds and more particularly to an articulating bed that can turn the body of a person on the bed to a side.

2. Related Technology

Dawakami et al, US 2005/0166323 and Taguchi et al., US 2005/0160530 each discloses a movable bed; Wei, US 2003/0121098 discloses a turning mechanism for a patient confined to a bed; Tekulve, U.S. Pat. No. 6,826,793 discloses an articulating bed frame; Paul, U.S. Pat. No. 6,789,280 discloses an articulated medical bed; Hensley, U.S. Pat. No. 6,393,641 discloses an articulated bed frame; Hayes et al., U.S. Pat. No. 5,205,004 discloses a vertically adjustable and tiltable bed frame; Suggitt et al., U.S. Pat. No. 5,515,561 discloses an articulating bed; Elliott, U.S. Pat. No. 5,537,701 discloses an adjustable articulated bed; Bathrick et al, U.S. Pat. No. 5,568,661 discloses an articulated bed with frame mounted power module; EP 0581474 discloses bed configurations; GB 2269916 discloses a hospital bed; and WO 2004/018901 discloses a linear actuator.

SUMMARY

One aspect of the invention provides an articulated bed, which may comprise: a first section configured to support at least part of a mattress thereon, a second section located next to the first section and configured to support at least part of a mattress thereon, and a mechanism configured to engage with the first section and to rotate the first side rail and the plurality of first mattress support bars rotate about the first axis. The first section may comprise a first side rail and a plurality of first mattress support bars extending generally parallel to one another, each first mattress support bar comprising a first end and a second end. At least one of the plurality of first mattress support bars may have the first end thereof fixed to the first side rail so as to integrate the at least one first mattress support bar with the first side rail. The at least one first mattress support bar is hinged about a first axis at a position thereof so as to rotate the first side rail about the first axis, wherein the position may have a first distance to the first end and a second distance to the second end, wherein the first distance is greater than the second distance.

In the foregoing articulated bed, the position of the first axis bar may be located at or in the vicinity of the second end of the at least one first mattress support bar. The articulated bed may further comprise a hinge support extending along the first axis under the plurality of first mattress support bars, wherein the at least one first mattress support bar forms a hinged connection with the hinge support about the first axis. The mechanism may comprise a first lifting bar arranged to extend along the first side rail, wherein the first side rail and the first lifting bar are configured to engage with each other such that lifting the first lifting bar lifts the first side rail and simultaneously rotates the first side rail about the first axis.

The mechanism may further comprise at least one lifting lever substantially perpendicularly attached to the first lifting bar and configured to hingedly rotate generally about the first axis so as to lift the first lifting bar as hingedly rotating generally about the first axis. The first side rail may have a recess from an underside thereof, and wherein the recess may be configured to receive the first lifting bar from the underside. The articulated bed may further comprise a base frame configured to support the first section and the second section. The base frame may comprise a side rail extending along the first side rail, wherein the side rail of the base frame may comprise a channel configured to receive the first lifting bar thereon.

Still in the foregoing articulated bed, the second section may comprise a second side rail and a plurality of second mattress support bars extending generally parallel to one another, each second mattress support bar comprising a first end and a second end, wherein at least one of the plurality of second mattress support bars may have the first end thereof, which may be fixed to the second side rail so as to integrate the at least one second mattress support bar with the second side rail. The at least one second mattress support bar of the second section may be hinged about a second axis at a position located at or in the vicinity of the second end of the second mattress support bar so as to rotate about the second axis, and wherein the mechanism may be further configured to engage with the second section and to lift the second side rail so as to rotate the second side rail and the at least one second mattress support bar about the second axis, which is substantially parallel to the first axis. Two neighboring ones of the plurality of first mattress support bars form a space therebetween, and wherein one of the plurality of second mattress support bars extends into the space. The second end of the at least one first mattress support bar may be spaced apart from the first side rail.

Still in the foregoing articulated bed, the first section may further comprise a second side rail and a plurality of second mattress support bars extending generally parallel to one another, each second mattress support bar comprising a first end and a second end, wherein at least one of the plurality of second mattress support bars may have the first end thereof, which may be fixed to the second side rail so as to integrate the at least one second mattress support bar with the second side rail, wherein the second side rail extends along the first side rail. The at least one second mattress support bar may be hinged about the first axis at a position thereof apart from the first end thereof so as to rotate about the first axis, and wherein the mechanism may be further configured to lift the second side rail so as to rotate the second side rail and the at least one second mattress support bar about the first axis. The mechanism may be configured to lift the first and second side rails simultaneously so as to rotate the first section about the first axis.

The foregoing articulated bed may further comprise another mechanism configured to rotate the first side rail and the at least one first mattress support bar about a third axis substantially perpendicular to the first axis. The articulated bed may further comprise another mechanism configured to rotate the second side rail and the at least one second mattress support bar about a fourth axis substantially perpendicular to the first axis. The other mechanism may be further configured to rotate a portion of the second section together with the first side rail and the at least one first mattress support bar about the third axis. The first section may further comprise at least one mattress support bar, each of which may comprise a first end and a second end, wherein the first end of each mattress support bar may be fixed to neither the first side rail nor the second side rail, and wherein the second end of each mattress support bar may be hinged about the first axis at a point of the mattress support bar, wherein the point may be closer to the second end than the first end thereof, wherein each mattress support bar may be rotatable about the first axis.

Still in the foregoing articulated bed, the first section may comprise a left or right portion of the bed. The left or right portion occupies more than one half the areas on which a mattress may be to be supported. The first section may comprise a head or leg portion of a left or right portion of the bed. The first side rail provides a side edge of the bed on which a mattress may be to be placed. The articulated bed may further comprise a mattress.

Another aspect of the invention provides a method of using an articulated bed. The method comprises: providing the articulated bed with one or more foregoing features; and lifting the first side rail using the mechanism so as to rotate the first side rail and the at least one first mattress support bar generally about the first axis. In this method, lifting the first side rail causes a person lying on the bed to turn the body of the person to a side. The articulated bed may further comprise another mechanism configured to rotate the first side rail and the at least one first mattress support bar about a third axis substantially perpendicular to the first axis. The method may further comprise lifting the first side rail using the other mechanism so as to rotate the first side rail and the at least one first mattress support bar about the third axis. The other mechanism may be further configured to rotate a portion of the second section together with the first side rail and the at least one first mattress support bar about the third axis. The method may further comprise substantially simultaneously rotating the first side rail, and the at least one first mattress support bar, and the portion of the second section about the third axis.

A further aspect of the invention provides an articulated bed. The articulated bed includes: a first section configured to support at least part of a mattress thereon, the first section including a first side rail and a plurality of first mattress support bars extending generally parallel to one another, each first mattress support bar including a first end and a second end, the first end being fixed to the first side rail so as to integrate each first mattress support bar with the first side rail, wherein each first mattress support bar is hinged about a first axis at a point located at or in the vicinity of the second end so as to rotate about the first axis. The bed further includes a second section located next to the first section and configured to support at least part of a mattress thereon; and a lifting mechanism configured to engage with the first section and to lift the first side rail so as to rotate the first side rail and the plurality of first mattress support bars rotate about the first axis.

In the foregoing articulated bed, each first mattress support bar may extend generally perpendicular to the first side rail. The point may be closer to the second end than the first end. The articulated bed may further include a hinge support extending along the first axis under the plurality of first mattress support bars and configured to provide each first mattress support bar with a hinged connection about the first axis.

The lifting mechanism may include a first lifting bar arranged to extend along the first side rail and configured to be lifted, and the first side rail and the first lifting bar may be configured to engage with each other such that lifting the first lifting bar lifts the first side rail and simultaneously rotates the first side rail and the plurality of first mattress support bars about the first axis. The lifting mechanism may further include at least two lifting arms substantially perpendicularly attached to the first lifting bar and configured to rotate generally about the first axis so as to lift the first lifting bar. The first side rail may have a recess from an underside thereof, and the recess may be configured to receive the first lifting bar from the underside. The articulated bed may further include a frame configured to support the first section, the second section and the lifting mechanism. The frame may include a first side bar extending along the first side rail and configured to receive the first lifting bar thereon.

The second section may include a second side rail and a plurality of second mattress support bars extending generally parallel to one another, each second mattress support bar including a first end and a second end, the first end being fixed to the second side rail so as to integrate each second mattress support bar with the second side rail. Each second mattress support bar of the second section may be hinged about a second axis at a point located at or in the vicinity of the second end of the second mattress support bar so as to rotate about the second axis, and the lifting mechanism may be further configured to engage with the second section and to lift the second side rail so as to rotate the second side rail and the plurality of second mattress support bars about the second axis substantially parallel to the first axis. The two neighboring ones of the plurality of first mattress support bars may form a space therebetween, and one of the plurality of second mattress support bars may extend into the space. The second end of each first mattress support bar may be spaced apart from the first side rail.

The first section may further include a second side rail and a plurality of second mattress support bars extending generally parallel to one another, each second mattress support bar including a first end and a second end, the first end being fixed to the second side rail so as to integrate each second mattress support bar with the second side rail, wherein the second side rail extends along the first side rail while spaced apart from the first side rail. Each second mattress support bar may be hinged about the first axis at a point thereof apart from the first end thereof so as to rotate about the first axis, and the lifting mechanism may be further configured to lift the second side rail so as to rotate the second side rail and the plurality of second mattress support bars rotate about the first axis. The lifting mechanism may be configured to lift the first and second side rails simultaneously so as to rotate the first section about the first axis.

The articulated bed may further include another lifting mechanism configured to rotate the first side rail and the plurality of first mattress support bars about a third axis substantially perpendicular to the first axis. The lifting mechanism and the other lifting mechanism are interconnected. The articulated bed may further include another lifting mechanism configured to rotate the second side rail and the plurality of second mattress support bars about a fourth axis substantially perpendicular to the first axis. The other lifting mechanism may be further configured to rotate a portion of the second section together with the first side rail and the plurality of first mattress support bars about the third axis. The first section may further include at least one mattress support bar, each of which includes a first end and a second end, wherein the first end of each mattress support bar is fixed to neither the first side rail nor the second side rail, and wherein the second end of each mattress support bar is hinged about the first axis at a point of the mattress support bar, wherein the point is closer to the second end than the first end thereof, wherein each mattress support bar is rotatable about the first axis.

The first section may include a left or right portion of the bed. The left or right portion occupies more than one half the areas on which a mattress may be to be supported. The first section may include a head or leg portion of a left or right portion of the bed. The first side rail may provide a side edge of the bed on which a mattress is to be placed. The articulated bed may further include a mattress.

Another aspect of the invention provides a method of using an articulated bed. The method includes: providing the above-described articulated bed; and lifting the first side rail using the lifting mechanism so as to rotate the first side rail and the plurality of first mattress support bars about the first axis while maintaining the second section in an original position thereof. The lifting of the first side rail may cause a person lying on the bed to turn the body of the person to a side.

The articulated bed may further include another lifting mechanism configured to rotate the first side rail and the plurality of first mattress support bars about a third axis substantially perpendicular to the first axis, wherein the method further includes lifting the first side rail using the other lifting mechanism so as to rotate the first side rail and the plurality of first mattress support bars about the third axis. The other lifting mechanism may be further configured to rotate a portion of the second section together with the first side rail and the plurality of first mattress support bars about the third axis, wherein the method further includes substantially simultaneously rotating the first side rail, and the plurality of first mattress support bars and the portion of the second section about the third axis.

Other features and advantages of the present invention will become apparent from the following more detailed description, taken in conjunction with the accompanying drawings, which illustrate, by way of example, the principles of the presently described apparatus and method of its use.

DETAILED DESCRIPTION OF EMBODIMENTS

Various features and advantages of the invention will be described in terms of embodiments and examples with reference to the foregoing drawings. Those having ordinary skill in the art may be able to make alterations and modifications what is described herein without departing from its spirit and scope. Therefore, it must be understood that what is illustrated and described herein is set forth only for the purposes of example and that it should not be taken as a limitation.

Figure 1:
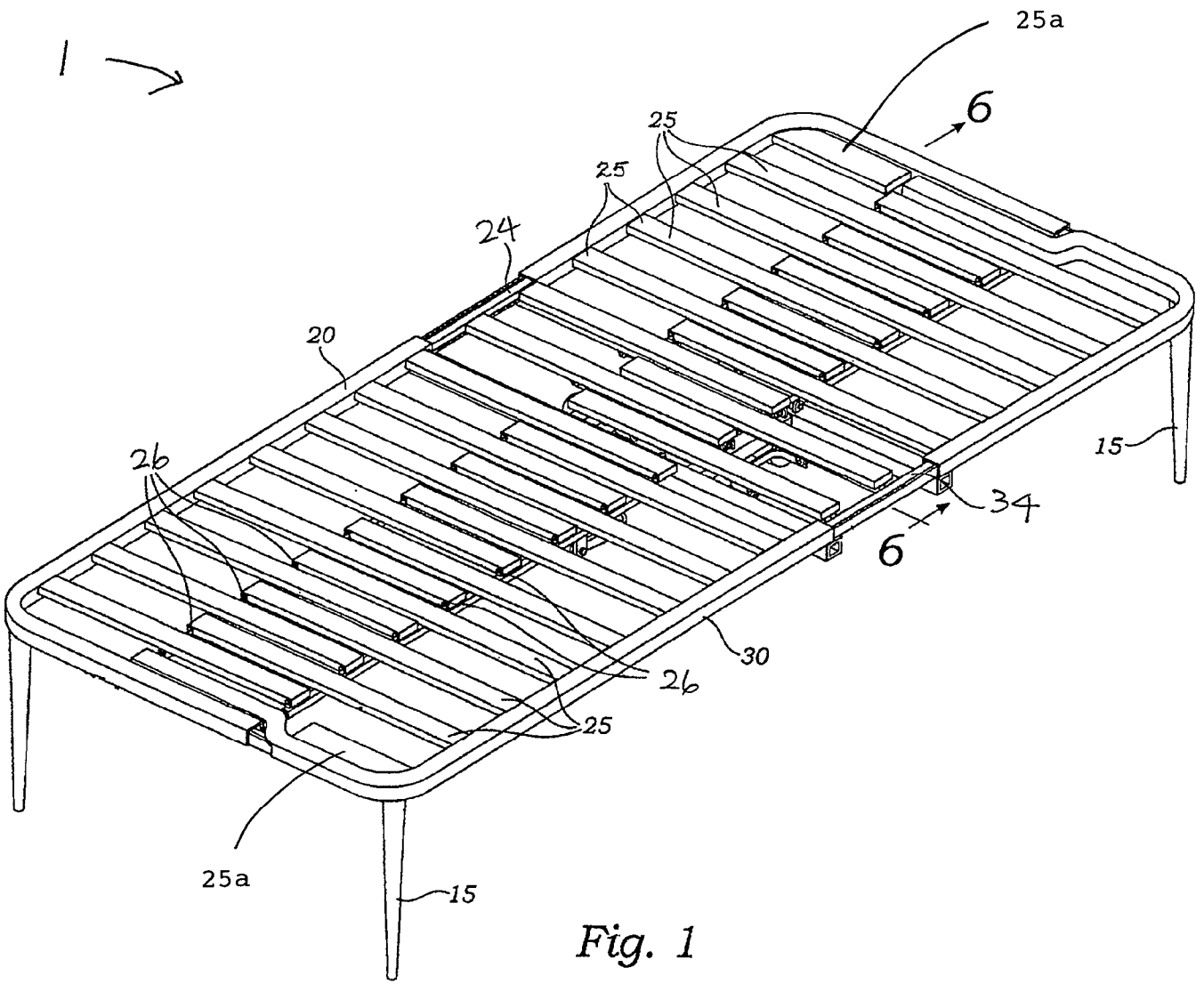
FIG. 1 is a perspective view of an embodiment of an articulated or articulating bed.
Figure 2:
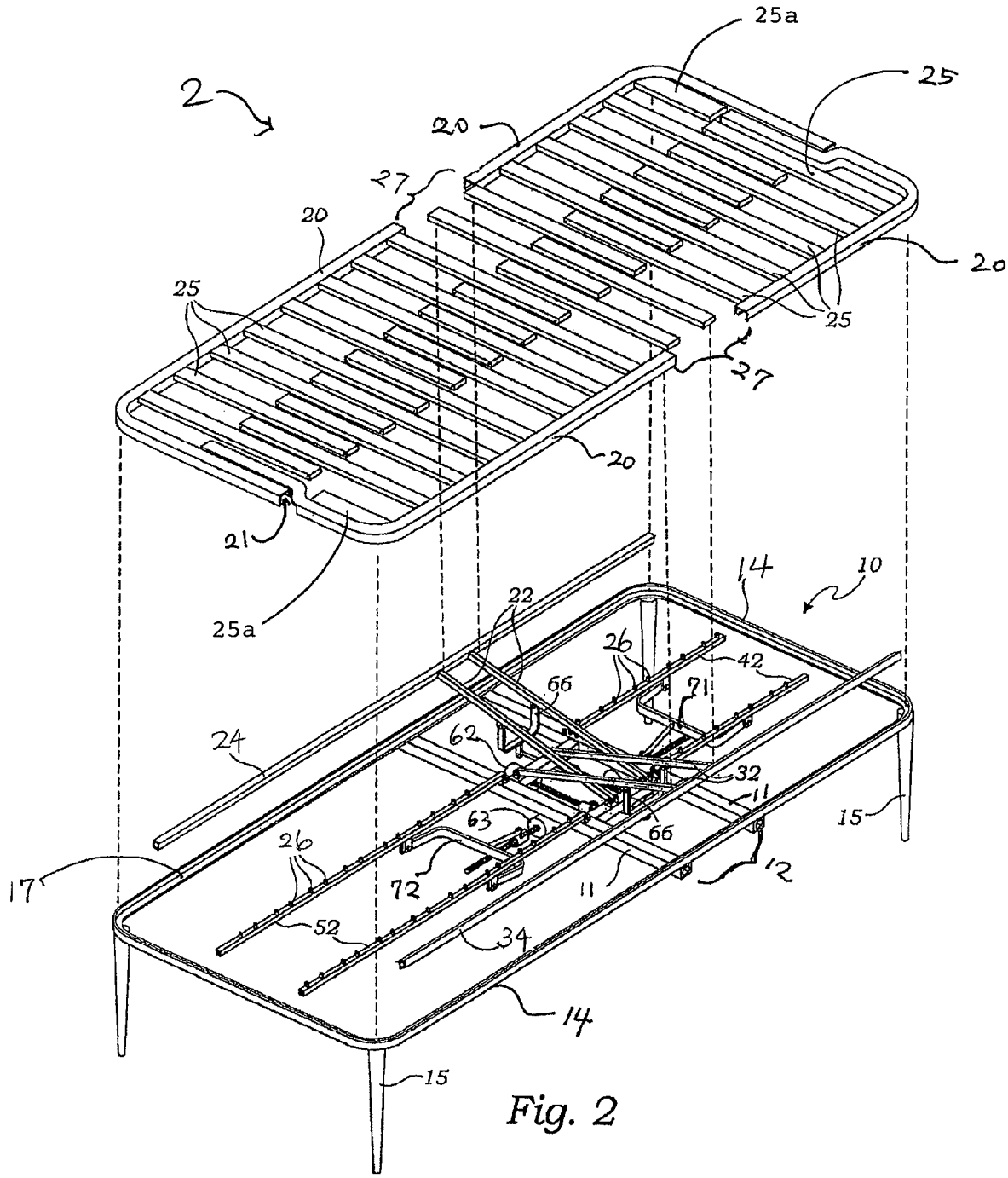
FIG. 2 is an exploded view of the articulated bed of FIG. 1.

Referring to FIGS. 1 and 2, the articulated or articulating bed I includes a base frame 10 and legs 15 for supporting the base frame 10. An articulable top frame 2 is placed over the base frame 10. The articulated bed 1 further includes articulating mechanisms for moving the articulable top frame 2, which will be discussed in more detail.

Base Frame

As illustrated in FIG. 2, the base frame 10 is composed of four side rails (left, right, top and bottom) 14, which are connected to form a generally rectangular shape. In the illustrated embodiment, the four side rails 14 have an L-shaped cross-section having a substantially right angle opening 17 facing inward and upward.

Articulable Top Frame

The articulable top frame 2 defines a mattress supporting area, over which a mattress can be placed. The articulable top frame 2 includes four side rails 20 and a plurality of mattress support plates or bars 25, which are integrated with at least one of the four side rails 20. The articulable top frame 2 is about the same size as the base frame 10 such that the side rails 14 of the base frame 10 are engaged with the articulable top frame 2.

In the illustrated embodiment, the left one of the side rails 20 of the articulable top frame 2 is aligned with the left one of the side rails 14 of the base frame 10. The left side rail 20 has two portions that are separated from each other, leaving a space 27 therebetween. Similarly, the right one of the side rails 20 of the articulable top frame 2 is aligned with the right one of the side rails 14 of the base frame 10. The right side rail 20 also has two separate portions, leaving a space 27 therebetween.

Figure 6:
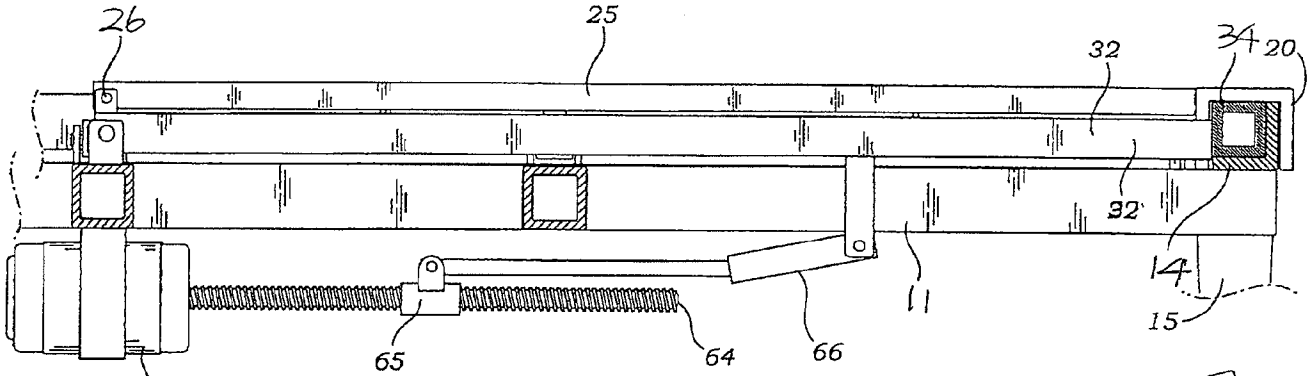
FIG. 6 is a partial sectional view taken along line 6-6 of FIG. 1.
Figure 7:
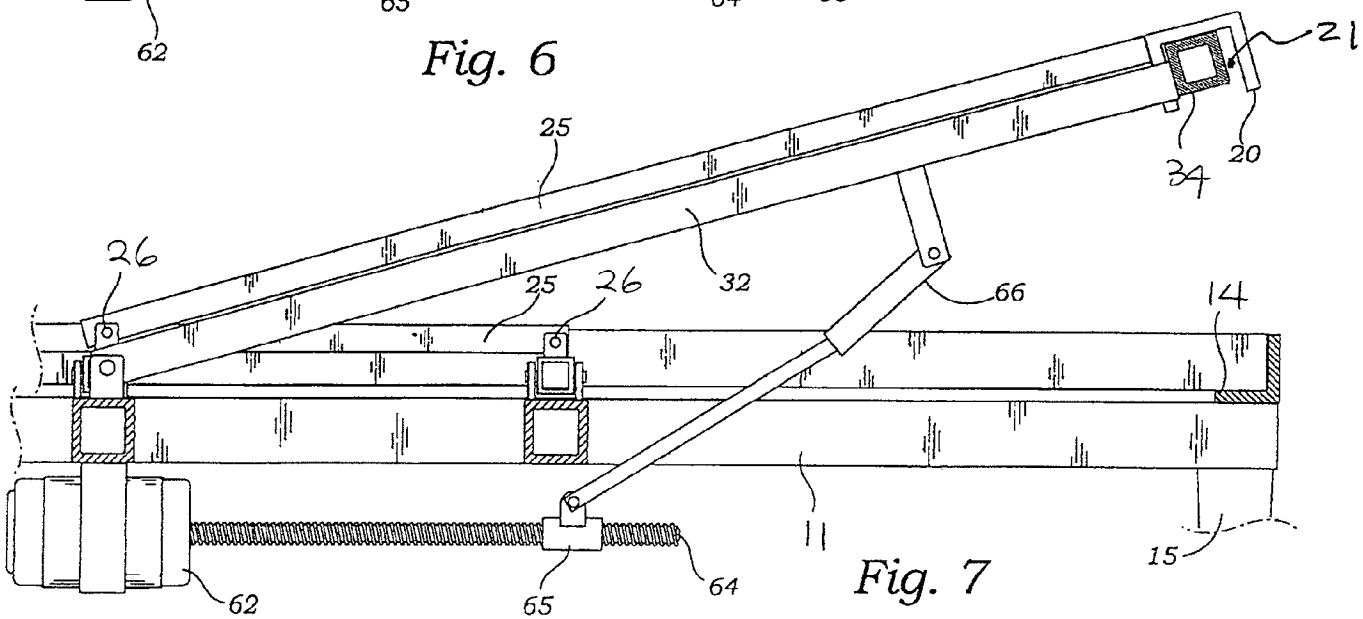
FIG. 7 is a partial sectional view taken along line 7-7 of FIG. 4.

Each of the side rails 20 of the articulable top frame 2 has an elongated recess 21 formed on their underside, which is better shown in FIG. 7. This recess 21 is to engage each side rail 20 with the base frame 10 and articulating mechanisms. More specifically, the recess 21 of the left and side rails 20 receives one of the L-shaped side rails 14 of the base frame 10. Also, the recess 21 of the left and right side rails 20 further receives a left/right-section lifting bar 24, 34. Referring to FIGS. 6 and 7, the recess 21 of the left and right side rails 20 are configured to receive both the left/right-section lifting bar 24, 34 and the L-shaped side rail 14 of the base frame 10 at the same time.

Mattress Support Bars

In the illustrated embodiment, mattress support bars 25 are substantially straight and are arranged generally parallel to each other. Most of the mattress support bars 25 have one end attached to either the left one or the right one of the side rails 20 of the articulable top frame 2. As illustrated, those mattress support bars 25 fixed to the left side rail and those fixed to the right side rail are alternatingly arranged. More specifically, two neighboring mattress support bars fixed to the left side rail have a gap therebetween, and one mattress support bar fixed to the right side rail at least partially extends into the gap. A few of the mattress support bars 25 are located between the spaces 27 formed between two portions of the left and right side rails 20. These mattress support bars 25 located between the spaces 27 are not fixed to either of the right or left side rails 20. The other end of each mattress support bar 25 is hingedly connected to a head/foot lifting lever 42, 52, which will be further discussed in detail. The illustrated embodiment further includes mattress support bars 25*a* (FIGS. 1, 2, 3, 4 and 5). One end of the mattress support bars 25*a* are fixed to the left side rail or the right side rail; and the other end of the mattress support bars 25*a* are not hingedly connected to the head/foot lifting lever 42, 52.

Overall, the side railsa 20 and the mattress support bars 25 form three sections In the top fram 2: a head section, a leg section and a middle section. In FIG. 2 the middle section is formed byu the mattress support bars 25 that are located between the spaces 27 and are not fixed to either of the right and left side rails 20. The middle section separates between the hesd section and the leg section of the top frame 2. The head section is formed by the portions of side rails 20 and the mattress support bars 25 fixed to these side rail portions, which are close to the upper right corner of FIG. 2. The leg section is formed by the portions of side rails 20 and the mattress support bars 25 fixed to these side rail portions, which are close to the lower left corner FIG. 2.

Articulating Mechanisms

The articulating mechanisms of the articulated bed 1 include a left/right section lifting mechanism, a head/leg section lifting mechanism, etc. These mechanisms are integrated with the base frame 10 via an H-frame 12. The H-frame 12 includes two parallel pipes 11 and additional two pipes interconnecting the pipes 11. The two parallel pipes 11 are fixed to the right and left side rails 14 of the base frame 10.

Head/Leg Section Lifting Mechanism

The head/leg section lifting mechanism includes actuation devices including an electric motor 63 (FIG. 2). Further, the head/leg section lifting mechanism includes a pair of head-section lifting levers 42 and a pair of foot section lifting levers 52, which are actuated by the electric motor 63.

Figure 3:
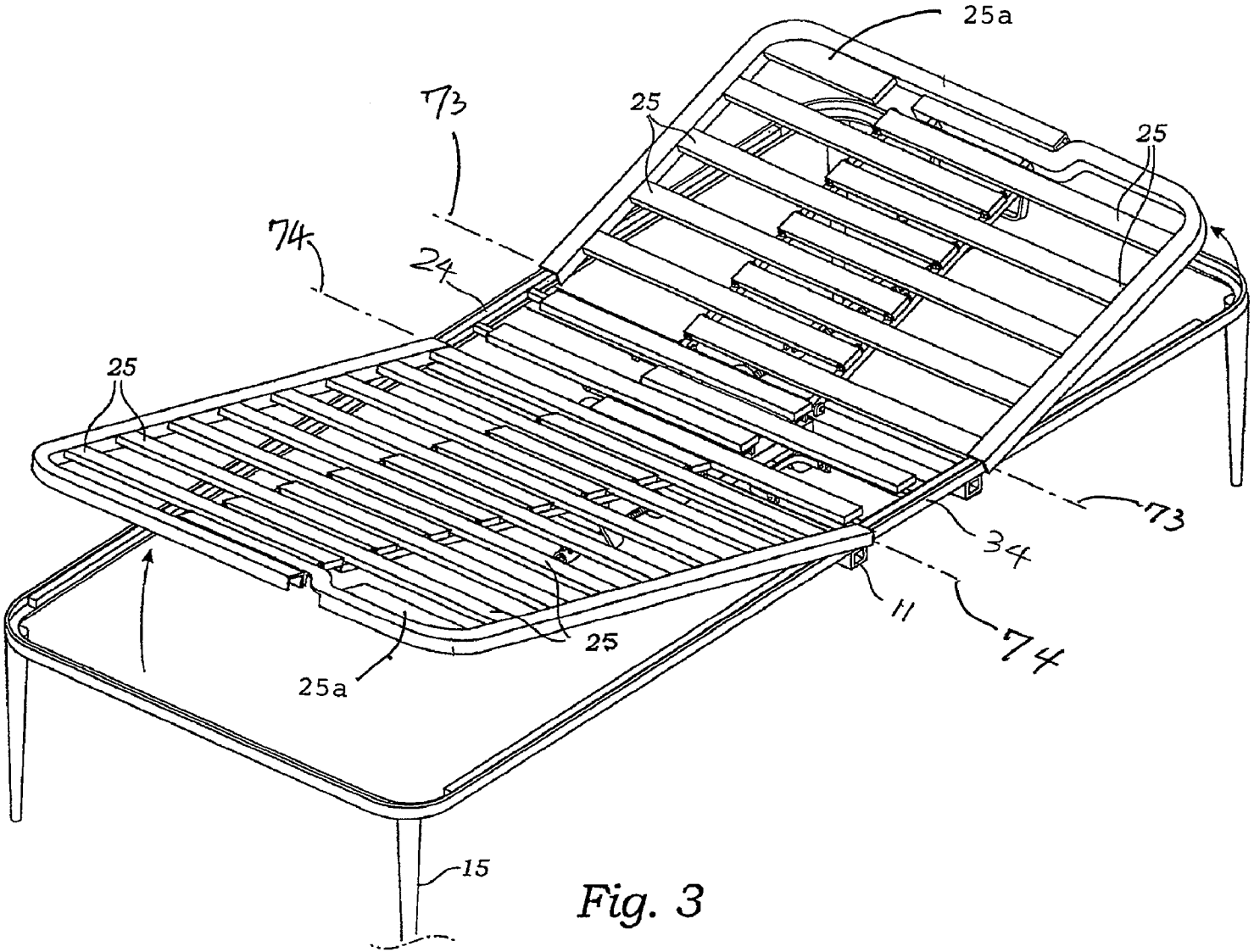
FIG. 3 is a perspective view of the articulated bed of FIG. 1, illustrating the head and foot sections raised.

Each of the head-section lifting levers 42 has one end hingedly connected to the H-frame 12 and is connected to a head yoke 71. Each of the leg-section lifting levers 52 has one end hingedly connected to the H-frame 12 and is connected to a leg yoke 72. With these connections, as the head yoke 71 is lifted, the head-section lifting levers 42 hingedly rotate about their hinge axis 73, thereby hingedly lifting the head section as shown in FIG. 3. Likewise, as the leg yoke 72 is lifted, the leg-section lifting levers 52 hingedly rotate about their hinge axis 74, thereby hingedly lifting the leg section.

Left/Right Section Lifting Mechanism

The left/right section lifting mechanism has actuation devices including an electric motor 62. Further, left/right section lifting mechanism includes the left-section lifting bar 24 and right-section lifting bar 34 that are actuated by the electric motor 62 (FIG. 2).

The left-section lifting bar 24 is fixed to a pair of left-section lifting levers 22. Each of the left-section lifting levers 22 has one end attached to the left-section lifting bar 24 and the other end hingedly connected to the H-frame 12 via a hinge (not shown). The right-section lifting bar 34 is fixed to a pair of right-section lifting levers 32. Each of the right-section lifting levers 32 has one end attached to the right-section lifting bar 34 and the other end hingedly connected to the H-frame 12 via a hinge 36 (FIGS. 6 and 7).

The left-section lifting levers 22 are connected to a left yoke 66 about their middle portion. The right-section lifting levers 32 are also connected to a right yoke 66 about their middle portion. As will be discussed later in connection with FIG. 7, as the right yoke 66 is lifted, the right-section lifting levers 32 hingedly rotate about their hinge axis, and the right-section lifting bar 34 is lifted. The left-section lifting levers 22 and left lifting bar 24 move likewise.

Hinged Connection of Mattress Support Bars

Each of the mattress support bars 25 are hingedly connected with one of the head-section lifting levers 42 and the leg-section lifting levers 52. There are a plurality of hinges 26 formed on each of the head-section lifting levers 42 and leg-section lifting levers 52. These hinges 26 form hinged connections with the mattress support bars 25 near one end of these bars that are located in the middle portion of the top frame 2.

More specifically, the left one of the head-section lifting levers 42 and the left one of the leg-section lifting levers 52 are hingedly connected at about the free end of the mattress supporting bars 25 that are fixed to the right side rail 20. The right one of the head-section lifting levers 42 and the right one of the leg-section lifting levers 52 are hingedly connected at about the free end of the mattress supporting bars 25 that are fixed to the left side rails 20.

Lifting of Left/Right Sections

Figure 4:
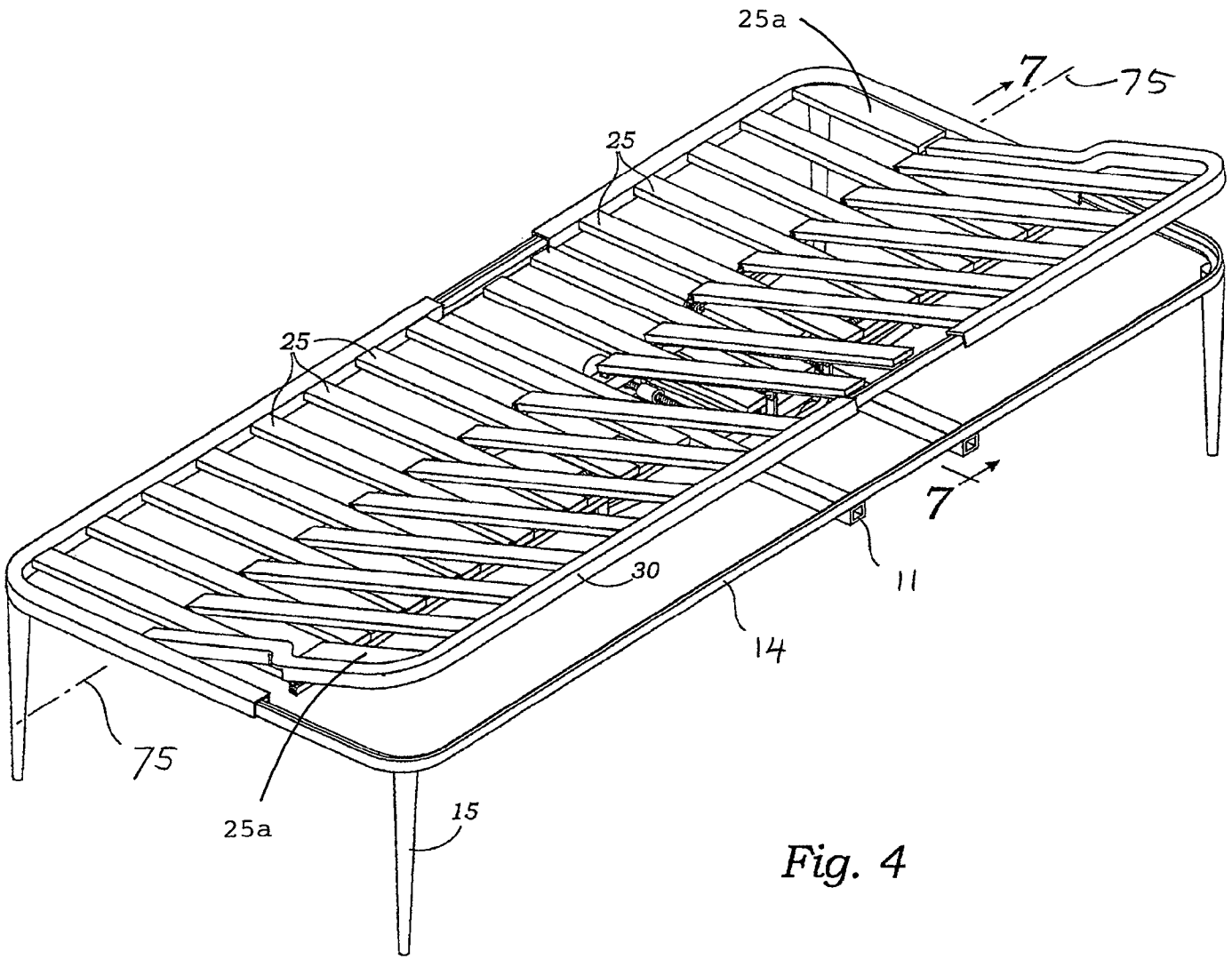
FIG. 4 is a perspective view of the articulated bed of FIG. 1, illustrating the right side section raised.

Referring to FIG. 4, the hinges 26 formed on the left one of the leg-section lifting levers 52 and the hinges 26 formed on the left one of the head-section lifting levers 42 are aligned to form a hinge axis 75. Upon operating the lifting mechanism for the right section, the right side rail 20 is lifted as it hingedly rotates about the hinge axis 75. As a result, the right section of the mattress supporting area turns about the hinge axis 75.

Figure 5:
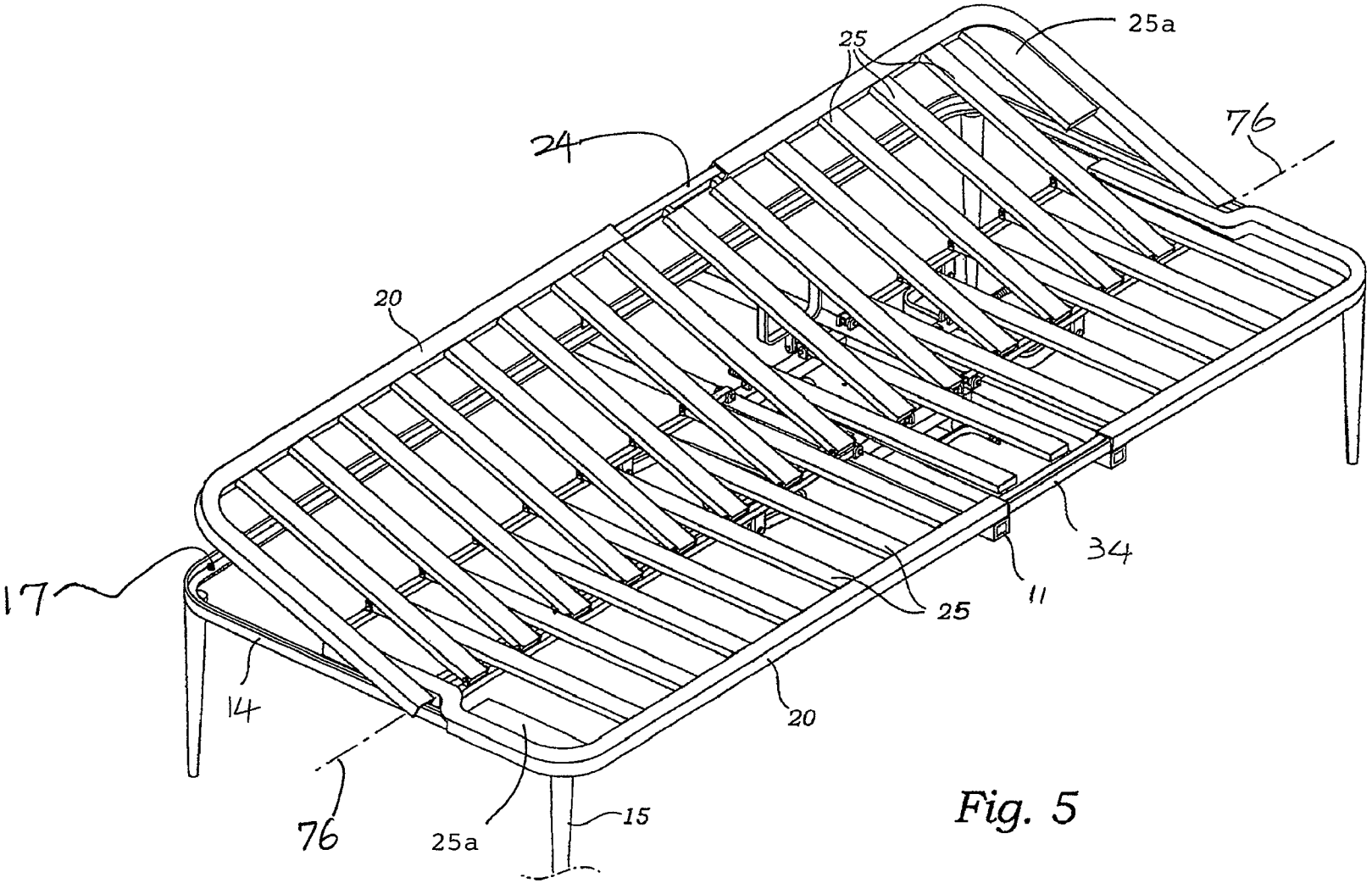
FIG. 5 is a perspective view of the articulated bed of FIG. 1, illustrating the left side section raised.

Referring to FIG. 5, the hinges 26 formed on the right one of the leg-section lifting lever 52 and the hinges 26 formed on the right one of the head-section lifting lever 42 are aligned to form a hinge axis 76. Upon operating the lifting mechanism for the left section, the left side rail 20 is lifted as it hingedly rotates about the hinge axis 76. As a result, the left section of the mattress supporting area turns about the hinge axis 76.

Actuation and Lifting of Right/Left Section

FIGS. 6 and 7 illustrate the left/right lifting mechanism including the actuating devices and their operation. The left/right lifting mechanism includes the electric motor 62, a drive screw 64 and a traveler nut 65. The electric motor 62 is connected to the drive screw 64 so as to drive it. The traveler nut 65 has threads that are engaged with the drive screw 64 such that it travels along the drive screw 64 as the drive screw 64 rotates. The traveler nut 65 is hingedly connected to a rod 67 attached to the fork-shaped yoke 66 that are integrated with the right-section lifting levers 32 (see FIG. 2).

Referring to FIG. 6, the articulated bed 1 is in a normal configuration for bedding. In this configuration, the right-section lifting bar 34 is settled on the L-shaped side rail 14 of the base frame 10, and the recess 21 formed underside of the right side rail 20 accommodates both the right-section lifting bar 32 and the L-shaped side rail 14. The traveler nut 65 is at about the middle of the extension of the drive screw 64 from the electric motor 62. The right-section lifting lever 32 is generally parallel with the pipe 11 of the H-frame 12. Further, the mattress support bar 25 attached to the right side rail 20 is also generally parallel with the pipe 11 of the H-frame 12.

In FIG. 7, on the other hand, the traveler nut 65 has moved to the right along the drive screw 64, and therefore the rod 67 has been pushed to the right too. However, the yoke 66 is fixed to the right-section lifting lever 32, and the yoke 66 and rode 67 do not move to the right. Rather, the rod 67 pivotally rotates about its pivotal axis formed on the traveler nut 65, which lifts the yoke 66 and the portion of the right-section lifting lever 32 where the yoke 66 is fixed. Because the right-section lifting lever 32 is connected to the H-frame 12 via the hinge 36, the right-section lifting lever 32 hingedly rotates about the axis of the hinge 36. The rotation of the right-section lifting lever 32 transfers to the right side rail 20 and mattress support bars 25 fixed thereto. Since the mattress support bars 25 are also hinged with the hinge 26, the mattress support bars 25 and the right side rail 20 also hingedly rotate about the hinge axis 75 (FIG. 4).

As discussed above, the illustrated articulated bed 1 provides the features and advantages of turning, lifting or rotating of the head section, the leg section, the right section, and the left section of its top frame 2 and mattress supporting area. With these features and advantages, the articulated bed 1 enables a patient lying on the bed not only to sit up or lift legs but also to turn his/her body to the right or left.

What is claimed is:

1. An articulated bed comprising:

a first section configured to support at least part of a mattress thereon, the first section comprising a first side rail and a plurality of first mattress support bars extending generally parallel to one another, each first mattress support bar comprising a first end and a second end, wherein at least one of the plurality of first mattress support bars has the first end thereof fixed to the first side rail so as to integrate the at least one of the plurality of first mattress support bars with the first side rail, wherein the at least one of the plurality of first mattress support bars is hinged about a first axis at a position thereof so as to rotate the first side rail about the first axis, wherein the position has a first distance to the first end and a second distance to the second end, wherein the first distance is greater than the second distance;

a second section located next to the first section and configured to support at least part of a mattress thereon; and a mechanism configured to engage with the first section and to rotate the first side rail and the plurality of first mattress support bars rotate about the first axis.

2. The articulated bed of claim 1, wherein the position of the first axis is located at or in the vicinity of the second end of the at least one of the plurality of first mattress support bars.

3. The articulated bed of claim 1, further comprising a hinge support extending along the first axis under the plurality of first mattress support bars, wherein the at least one of the plurality of first mattress support bars forms a hinged connection with the hinge support about the first axis.

4. The articulated bed of claim 1, wherein the mechanism comprises a first lifting bar arranged to extend along the first side rail, wherein the first side rail and the first lifting bar are configured to engage with each other such that lifting the first lifting bar lifts the first side rail and simultaneously rotates the first side rail about the first axis.

5. The articulated bed of claim 4, wherein the mechanism further comprises at least one lifting lever substantially perpendicularly attached to the first lifting bar and configured to hingedly rotate generally about the first axis so as to lift the first lifting bar as hingedly rotating generally about the first axis.

6. The articulated bed of claim 4, wherein the first side rail has a recess from an underside thereof, and wherein the recess is configured to receive the first lifting bar from the underside.

7. The articulated bed of claim 4, further comprising a base frame configured to support the first section and the second section.

8. The articulated bed of claim 7, wherein the base frame comprises a side rail extending along the first side rail, wherein the side rail of the base frame comprises a channel configured to receive the first lifting bar thereon.

9. The articulated bed of claim 4, wherein the first section further comprises a second side rail and a plurality of second mattress support bars extending generally parallel to one another, each second mattress support bar comprising a first end and a second end, wherein at least one of the plurality of second mattress support bars has the first end thereof fixed to the second side rail so as to integrate the at least one of the plurality of second mattress support bars with the second side rail, wherein the second side rail extends along the first side rail.

10. The articulated bed of claim 9, wherein the at least one of the plurality of second mattress support bars is hinged about the first axis at a position thereof apart from the first end thereof so as to rotate about the first axis, and wherein the mechanism is further configured to lift the second side rail so as to rotate the second side rail and the at least one of the plurality of second mattress support bars about the first axis.

11. The articulated bed of claim 9, wherein the mechanism is configured to lift the first and second side rails simultaneously so as to rotate the first section about the first axis.

12. The articulated bed of claim 9, further comprising another mechanism configured to rotate the first side rail and the at least one of the plurality of first mattress support bars about a third axis substantially perpendicular to the first axis.

13. The articulated bed of claim 12, further comprising another mechanism configured to rotate the second side rail and the at least one of the plurality of second mattress support bars about a fourth axis substantially perpendicular to the first axis.

14. The articulated bed of claim 12, wherein the other mechanism is further configured to rotate a portion of the second section together with the first side rail and the at least one of the plurality of first mattress support bars about the third axis.

15. The articulated bed of claim 9, wherein the first section further comprises at least one mattress support bar, each of which comprises a first end and a second end, wherein the first end of each mattress support bar is fixed to neither the first side rail nor the second side rail, and wherein the second end of each mattress support bar is hinged about the first axis at a point of the mattress support bar, wherein the point is closer to the second end than the first end thereof, wherein each mattress support bar is rotatable about the first axis.

16. The articulated bed of claim 1, wherein the second section comprises a second side rail and a plurality of second mattress support bars extending generally parallel to one another, each second mattress support bar comprising a first end and a second end, wherein at least one of the plurality of second mattress support bars has the first end thereof fixed to the second side rail so as to integrate the at least one of the plurality of second mattress support bars with the second side rail.

17. The articulated bed of claim 16, wherein the at least one of the plurality of second mattress support bars of the second section is hinged about a second axis at a position located at or in the vicinity of the second end of the second mattress support bar so as to rotate about the second axis, and wherein the mechanism is further configured to engage with the second section and to lift the second side rail so as to rotate the second side rail and the at least one of the plurality of second mattress support bars about the second axis, which is substantially parallel to the first axis.

18. The articulated bed of claim 16, wherein two neighboring ones of the plurality of first mattress support bars form a space therebetween, and wherein one of the plurality of second mattress support bars extends into the space.

19. The articulated bed of claim 16, wherein the second end of the at least one of the plurality of first mattress support bars is spaced apart from the first side rail.

20. The articulated bed of claim 1, wherein the first section comprises a left or right portion of the bed.

21. The articulated bed of claim 20, wherein the left or right portion occupies more than one half the areas on which a mattress is to be supported.

22. The articulated bed of claim 1, wherein the first section comprises a head or leg portion of a left or right portion of the bed.

23. The articulated bed of claim 1, wherein the first side rail provides a side edge of the bed on which a mattress is to be placed.

24. The articulated bed of claim 23, further comprising a mattress.

25. A method of using an articulated bed, the method comprising:

providing the articulated bed of claim 1; and lifting the first side rail using the mechanism so as to rotate the first side rail and the at least one of the plurality of first mattress support bars generally about the first axis.

26. The method of claim 25, wherein lifting the first side rail causes a person lying on the bed to turn the body of the person to a side.

27. The method of claim 25, wherein the articulated bed further comprises another mechanism configured to rotate the first side rail and the at least one of the plurality of first mattress support bars about a third axis substantially perpendicular to the first axis, wherein the method further comprises lifting the first side rail using the other mechanism so as to rotate the first side rail and the at least one of the plurality of first mattress support bars about the third axis.

28. The method of claim 27, wherein the other mechanism is further configured to rotate a portion of the second section together with the first side rail and the at least one of the plurality of first mattress support bars about the third axis, wherein the method further comprises substantially simultaneously rotating the first side rail, and the at least one of the plurality of first mattress support bars, and the portion of the second section about the third axis.

* * * * *